US010479956B2

(12) United States Patent
Ortiz et al.

(10) Patent No.: US 10,479,956 B2
(45) Date of Patent: Nov. 19, 2019

(54) NON-NEWTONIAN ENGINE OIL WITH SUPERIOR ENGINE WEAR PROTECTION AND FUEL ECONOMY

(71) Applicant: ExxonMobil Research and Engineering Company, Annandale, NJ (US)

(72) Inventors: Nancy Ortiz, Laredo, TX (US); Douglas E. Deckman, Mullica Hill, NJ (US); Kevin J. Kelly, Mullica Hill, NJ (US); David G. L. Holt, Medford, NJ (US); Haris Junuzovic, Hamburg (DE); Camille A. Killian, Swedesboro, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 96 days.

(21) Appl. No.: 15/703,117

(22) Filed: Sep. 13, 2017

(65) Prior Publication Data

US 2018/0112149 A1 Apr. 26, 2018

Related U.S. Application Data

(60) Provisional application No. 62/396,923, filed on Sep. 20, 2016.

(51) Int. Cl.
*C10M 169/04* (2006.01)
*C10M 101/00* (2006.01)
(Continued)

(52) U.S. Cl.
CPC ..... *C10M 169/044* (2013.01); *C10M 101/00* (2013.01); *C10M 129/95* (2013.01);
(Continued)

(58) Field of Classification Search
CPC ..... C10M 169/044; C10M 143/12; C10M 129/95; C10M 161/00; C10M 135/22;
(Continued)

(56) References Cited

U.S. PATENT DOCUMENTS 1,815,022 A 7/1931 Davis
2,191,498 A 2/1940 Reiff
(Continued)

FOREIGN PATENT DOCUMENTS

CA 1094044 A1 1/1981
EP 0471071 B1 2/1991
(Continued)

OTHER PUBLICATIONS

The International Search Report and Written Opinion of PCT/US2017/051459 dated Dec. 1, 2017.
(Continued)

*Primary Examiner* — Taiwo Oladapo
(74) *Attorney, Agent, or Firm* — Robert A. Migliorini

(57) ABSTRACT

Provided is a non-Newtonian engine oil lubricant composition with improved fuel efficiency and engine wear protection. The lubricant composition includes a major amount of a base oil including a Group II base stock and an optional Group V base stock, from 0.1 to 9.0 wt. % of at least one viscosity modifier and from 0.1 to 1.2 wt. % of at least one friction modifier. The non-Newtonian engine oil lubricant composition has a kinematic viscosity at 100 deg. C. of less than or equal to 10 cSt and an HTHS (ASTM D4683) of less than or equal to 2.2 cP at 150° C. Also provided are methods of using the lubricant composition in internal combustion engines and methods of making the lubricant composition.

22 Claims, 7 Drawing Sheets

| Variable | Comparative Example 1 0W-20 | Comparative Example 2 Newtonian 0W-12 | Unit |
|---|---|---|---|
| KV40°C | 39 | 30 | mm²/s |
| KV100°C | 7.8 | 6.1 | mm²/s |
| TBN | 8.7 | 8.4 | mgKOH/g |
| HTHS, cP | 2.6 | 2.2 | cP |
| Pour Point | -57 | <-60 | °C |
| CCS Viscosity,-35°C | 4140 | 3730 | mPa·s |
| MRV Yield Stress, -40°C | <35 | <35 | Pa |
| MRV Viscosity, -40°C | 10000 | 7400 | mPa·s |
| Boron | 0.031 | 0.031 | % m |
| Calcium | 0.175 | 0.175 | % m |
| Molybdenum | 0.008 | 0.008 | % m |
| Phosphorus | 0.086 | 0.078 | % m |
| Zinc | 0.096 | 0.086 | % m |
| Sulfated Ash | 0.8 | 0.8 | % m |
| Noack Evaporation Loss | 10.2 | 10.4 | % m |
| Sulfur | 0.21 | 0.18 | % m |

(51) Int. Cl.
*C10M 129/95* (2006.01)
*C10M 135/22* (2006.01)
*C10M 143/12* (2006.01)
*C10M 161/00* (2006.01)

(52) U.S. Cl.
CPC ..... *C10M 135/22* (2013.01); *C10M 143/12* (2013.01); *C10M 161/00* (2013.01); *C10M 2203/003* (2013.01); *C10M 2205/06* (2013.01); *C10M 2207/34* (2013.01); *C10M 2227/06* (2013.01); *C10N 2230/06* (2013.01); *C10N 2240/10* (2013.01)

(58) Field of Classification Search
CPC ..... C10M 101/00; C10M 171/02; C10M 2219/068; C10M 2207/289; C10M 2219/024; C10M 2227/066; C10M 2223/045; C10M 2203/1025; C10M 2207/2805; C10M 2205/028; C10M 2207/40; C10M 2207/125; C10M 2205/223; C10M 2215/04; C10M 2205/173; C10M 2207/0406; C10M 2205/026; C10M 2209/084; C10M 2205/022; C10M 2205/22; C10M 2203/003; C10M 2207/34; C10M 2205/06; C10M 2227/06; C10M 2207/24; C10M 2205/04; C10N 2230/06; C10N 2230/54; C10N 2220/02; C10N 2220/029; C10N 2240/10; C10N 2240/102; C10N 2240/104; C10N 2220/04; C10N 2230/68
See application file for complete search history.

(56) References Cited

U.S. PATENT DOCUMENTS

| | | | |
|---|---|---|---|
| 2,387,501 | A | 10/1945 | Dietrich |
| 2,655,479 | A | 10/1953 | Munday et al. |
| 2,721,877 | A | 10/1955 | Popkin et al. |
| 2,721,878 | A | 10/1955 | Popkin |
| 3,036,003 | A | 5/1962 | Verdol |
| 3,087,936 | A | 4/1963 | Le Suer |
| 3,172,892 | A | 3/1965 | Le Suer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Pisek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,910,355 | A | 3/1990 | Shubkin et al. |
| 4,956,122 | A | 9/1990 | Watts et al. |
| 5,068,487 | A | 11/1991 | Theriot |
| 5,084,197 | A | 1/1992 | Galic et al. |
| 5,705,458 | A | 1/1998 | Roby et al. |
| 5,824,627 | A | 10/1998 | McConnachie et al. |
| 5,837,657 | A | 11/1998 | Fang et al. |
| 5,863,873 | A | 1/1999 | Bovington |
| 5,906,968 | A | 5/1999 | McConnachie et al. |
| 6,034,039 | A | 3/2000 | Gomes et al. |
| 6,101,987 | A | 8/2000 | Saur et al. |
| 6,110,878 | A | 8/2000 | McConnachie et al. |
| 6,143,701 | A | 11/2000 | Bolla |
| 6,153,564 | A | 11/2000 | Arunasalam et al. |
| 6,232,276 | B1 | 5/2001 | Stiefel et al. |
| 6,569,820 | B2 | 5/2003 | McConnachie et al. |
| 6,689,725 | B1 | 2/2004 | Gao |
| 6,730,638 | B2 | 5/2004 | Farng et al. |
| 6,734,150 | B2 | 5/2004 | Gao et al. |
| 2013/0137617 | A1* | 5/2013 | Lyon ..... C10M 169/02 508/374 |

FOREIGN PATENT DOCUMENTS

| | | | |
|---|---|---|---|
| EP | 0262977 | A2 | 4/1998 |
| WO | 98/26030 | A1 | 6/1998 |
| WO | 99/47629 | A1 | 9/1999 |
| WO | 99/66013 | A1 | 12/1999 |
| WO | 2008005100 | A1 | 1/2008 |

OTHER PUBLICATIONS

Audi AG/Exxon Mobil, "Ultra-Low Viscosity Engine Oil Prototype Developement" Power-Point Presentation, Jun. 13, 2016, Ingolstadt.

* cited by examiner

FIGURE 1

| Variable | Comparative Example 1 0W-20 | Comparative Example 2 Newtonian 0W-12 | Unit |
|---|---|---|---|
| KV40°C | 39 | 30 | $mm^2/s$ |
| KV100°C | 7.8 | 6.1 | $mm^2/s$ |
| TBN | 8.7 | 8.4 | mgKOH/g |
| HTHS, cP | 2.6 | 2.2 | cP |
| Pour Point | -57 | <-60 | °C |
| CCS Viscosity,-35°C | 4140 | 3730 | mPa·s |
| MRV Yield Stress, -40°C | <35 | <35 | Pa |
| MRV Viscosity, -40°C | 10000 | 7400 | mPa·s |
| Boron | 0.031 | 0.031 | % m |
| Calcium | 0.175 | 0.175 | % m |
| Molybdenum | 0.008 | 0.008 | % m |
| Phosphorus | 0.086 | 0.078 | % m |
| Zinc | 0.096 | 0.086 | % m |
| Sulfated Ash | 0.8 | 0.8 | % m |
| Noack Evaporation Loss | 10.2 | 10.4 | % m |
| Sulfur | 0.21 | 0.18 | % m |

| Component, wt% | Comparative Example 1 | Comparative Example 2 | Inventive Example 1 | Inventive Example 2 | Inventive Example 3 | Inventive Example 4 | Inventive Example 5 | Inventive Example 6 |
|---|---|---|---|---|---|---|---|---|
| Other Additives | 8.79 | 5.9 | 7.88 | 7.88 | 8.13 | 6 | 6 | 6.26 |
| Dispersant | 7.83 | 7.83 | 7.83 | 7.83 | 7.83 | 7.83 | 7.83 | 7.83 |
| FM 1 - Mo alkyl thio carbamide | 0.15 | 0.15 | 0.15 | 0.15 | 0.15 | 0.15 | 0.15 | 0.15 |
| FM 2 - ethoxylated fatty ester | | | | 0.7 | 0.70 | | 0.7 | 0.70 |
| VM1 - styrene isoprene star | 0.18 | | 0.12 | 0.12 | 0.12 | | | |
| VM2 - styrene isoprene block | 0.36 | | 0.36 | 0.36 | 0.36 | 0.12 | 0.12 | 0.12 |
| 3 cSt Group II | | | 75.02 | 74.32 | 74.10 | 79.42 | 78.72 | 78.48 |
| 4 cSt Group III | 54.05 | 60.72 | | | | | | |
| 4 cSt Group IV | 23.24 | 20 | 3.24 | 3.24 | 3.23 | 1.08 | 1.08 | 1.08 |
| 4 cSt Group V Ester | 5.4 | 5.4 | 5.4 | 5.4 | 5.38 | 5.4 | 5.4 | 5.38 |
| KV100 (cSt) | 7.80 | 6.08 | 5.57 | 5.67 | 5.72 | 4.53 | 4.62 | 4.66 |
| KV40 (cSt) | 45* | 30.01 | 23.51 | 24.03 | 24.28 | 19.03 | 19.45 | 19.7 |
| Calculated Viscosity Index | 143.6 | 155.4 | 189.9 | 190.2 | 191.1 | 160.7 | 162.5 | 163.4 |
| HTHS150 (cP) | 2.51 | 2.159 | 1.97 | 1.985 | 2 | 1.69 | 1.75 | 1.73 |
| HFRR Avg. Wear Scar (um) | 174 | 173.5 | | 179.5 | | | 160 | 165 |
| HFRR Avg Friction Coefficient | 0.102 | 0.099 | | 0.101 | | | 0.094 | 0.097 |
| HFRR film formation (%) | 48 | 71 | | 41 | | | 49 | 42 |
| MTM Avg TC1, 50 C | 0.052 | 0.053 | | 0.054 | | | 0.055 | 0.057 |
| MTM Avg TC1, 100 C | 0.056 | 0.056 | | 0.070 | | | 0.058 | 0.064 |
| MTM Avg TC1, 140 C | 0.082 | 0.066 | | 0.053 | | | 0.084 | 0.093 |
| Mo content (ppm) | 0.008 | 0.008 | 0.008 | 0.008 | 0.008 | 0.008 | 0.008 | 0.008 |

FIGURE 2

| Component, wt% | Comparative Example 1 | Comparative Example 2 | Inventive Example 1 | Inventive Example 2 | Inventive Example 3 | Inventive Example 4 | Inventive Example 5 | Inventive Example 6 |
|---|---|---|---|---|---|---|---|---|
| Other Additives | 8.79 | 5.9 | 7.88 | 7.88 | 8.13 | 6.0 | 6.0 | 6.26 |
| Dispersant | 7.83 | 7.83 | 7.83 | 7.83 | 7.83 | 7.83 | 7.83 | 7.83 |
| FM 1 - Mo alkyl thio carbamide | 0.15 | 0.15 | 0.15 | 0.15 | 0.15 | 0.15 | 0.15 | 0.15 |
| FM 2 – polymeric ethoxylated fatty ester | | | | 0.70 | 0.70 | | 0.70 | 0.70 |
| VM1 - styrene isoprene star | 0.18 | | 0.12 | 0.12 | 0.12 | | | |
| VM2 - styrene isoprene block | 0.36 | | 0.36 | 0.36 | 0.36 | 0.12 | 0.12 | 0.12 |
| 3 cSt Group IIa | | | 75.0 | 74.3 | 74.1 | 79.4 | 78.7 | 78.5 |
| 4 cSt Group III | 54.0 | 60.7 | | | | | | |
| 4 cSt Group IV | 23.2 | 20 | 3.2 | 3.2 | 3.2 | 1.1 | 1.1 | 1.1 |
| 4 cSt Group V Ester | 5.4 | 5.4 | 5.4 | 5.4 | 5.4 | 5.4 | 5.4 | 5.4 |
| KV100 (cSt) | 7.80 | 6.08 | 5.57 | 5.67 | 5.72 | 4.53 | 4.62 | 4.66 |
| KV40 (cSt) | 45.0 | 30.0 | 23.5 | 24.0 | 24.3 | 19.0 | 19.4 | 19.7 |
| Calculated Viscosity Index | 144 | 155 | 190 | 190 | 191 | 161 | 162 | 163 |
| HTHS150 (cP) | 2.51 | 2.16 | 1.97 | 1.99 | 2.00 | 1.69 | 1.75 | 1.73 |
| HFRR Avg. Wear Scar (μm) | 174 | 173.5 | | 179.5 | | | 160 | 165 |
| Mo content (ppm) | 0.008 | 0.008 | 0.008 | 0.008 | 0.008 | 0.008 | 0.008 | 0.008 |

FIGURE 2 (Continued)

FIGURE 3

| Component, wt% | Comparative Example 1 | Comparative Example 2 | Inventive Example 7 | Inventive Example 8 | Inventive Example 9 | Inventive Example 10 | Inventive Example 11 | Inventive Example 12 |
|---|---|---|---|---|---|---|---|---|
| Other Additives | 8.79 | 5.9 | 5.9 | 5.9 | 5.9 | 5.9 | 6.0 | 6.0 |
| Dispersant | 7.83 | 7.83 | 7.83 | 3.92 | 7.83 | 3.92 | 7.83 | 7.83 |
| FM 1 – Mo trimeric alkyl thio carbamide | 0.15 | 0.15 | 0.15 | 0.15 | | | 0.15 | 0.15 |
| FM 2 – polymeric ethoxylated fatty ester | | | | | | | 0.7 | 0.7 |
| FM 1b - Mo dimeric alkyl thio carbamide | | | | | 0.7 | 0.7 | | |
| FM 3 - saturated ashless organic | | | 0.5 | 0.5 | 0.5 | 0.5 | | |
| VM1 - styrene isoprene star | 0.18 | | | | | | | |
| VM2 - styrene isoprene block | 0.36 | | | | | | | |
| VM3 - polymethacrylate 2* | | | 3.0 | 6.0 | | 5.56 | 3.65 | 5.2 |
| VM4 - polymethacrylate 1* | | | | | 4.1 | | | |
| 3 cSt Group IIa | | | 82.6 | 83.5 | 81.0 | 83.4 | 78.7 | |
| 3 cSt Group IIb | | | | | | | | 80.1 |
| 4 cSt Group III | 54.1 | 60.7 | | | | | | |
| 4 cSt Group IV | 23.2 | 20 | | | | | | |
| 4 cSt Group V Ester | 5.4 | 5.4 | | | | | 3.0 | |
| KV100 (cSt) | 7.80 | 6.08 | 5.10 | 5.22 | 5.16 | 5.19 | 5.59 | 5.63 |
| KV40 (cSt) | 45.0 | 30.0 | 19.3 | 17.0 | 19.5 | 16.9 | 20.6 | 17.8 |
| Calculated Viscosity Index | 144 | 155 | 214 | 278 | 216 | 277 | 236 | 298 |
| HTHS150 (cP) | 2.51 | 2.16 | 1.92 | 1.92 | 1.88 | 1.91 | 2.02 | 2.00 |
| HFRR Avg. Wear Scar (µm) | 174 | 173.5 | 181 | 139 | 134 | | 170.5 | 161 |
| Mo content (ppm) | 0.008 | 0.008 | 0.008 | 0.008 | 0.070 | 0.070 | 0.008 | 0.008 |

**VM is added as a concentrate of 20 - 30% solid polymer in base oil*

FIGURE 4

| M271 Wear | Comparative Example 2 Newtonian 0W-12 | Inventive Example 2 | MB 225.30 Limits |
|---|---|---|---|
| Inlet Camshaft wear avg, µm | 1.7 | 1.4 | 5.0 max |
| Outlet Camshaft wear avg, µm | 2.4 | 2.1 | 5.0 max |
| 1st rings radial wear avg, µm | 3.8 | 4.4 | 5.0 max |
| 2nd rings radial wear avg, µm | 6.3 | 5.6 | 12.0 max |
| 1st rings axial wear avg, µm | 1.8 | 1.2 | 5.0 max |
| 1st ring grooves axial wear avg, µm | 8 | 7.4 | 15.0 max |
| Ring sticking | none | none | none |
| Main bearings wear avg, µm | 0.7 | 0 | 1.5 max |
| Main bearings wear max, µm | 3.1 | 0.1 | 3.5 max |
| Conrod bearings wear avg, µm | 0.8 | 1.3 | 1.5 max |
| Conrod bearings wear max, µm | 1.2 | 1.9 | 3.5 max |
| Timing chain elongation, % | 0.1 | 0.12 | 0.25 max |
| Timing chain single chain link, % | 0.2 | 0.4 | 1.0 max |
| oil consumption g/h | 6.8 | 13.3 | n/a |

FIGURE 5

| Component, wt% | Inventive Example 11 | Inventive Example 12 |
|---|---|---|
| Other Additives | 6.0 | 6.0 |
| Dispersant | 7.83 | 7.83 |
| FM 1 - Mo alkyl thio carbamide | 0.15 | 0.15 |
| FM 2 - ethoxylated fatty ester | 0.7 | 0.7 |
| VM3 - polymethacrylate 2* | 3.65 | 5.2 |
| 3 cSt Group II | 78.7 | |
| 3 cSt Group II | | 80.1 |
| 4 cSt Group V Ester | 3.0 | |
| WLTC FE%, Audi A4 Gasoline** | 0.50 | 0.29 |
| WLTC FE%, Audi A6 Diesel** | 1.64 | 2.40 |
| WLTC FE%, MB E220d Diesel** | 1.77 | 1.76 |

**VM is added as a concentrate of 20 - 30% solid polymer in base oil*
***Fuel economy measured vs. 0W-20 finished oil*

FIGURE 6

| Component, wt% | WLTC Reference Oil (0W-20) |
|---|---|
| Other Additives | 23.26 |
| FM 1 – Mo trimeric alkyl thio carbamide | 0.15 |
| VM1 - styrene isoprene star | 0.18 |
| VM2 - styrene isoprene block | 0.36 |
| 4 cSt Group III | 54.1 |
| 4 cSt Group IV | 19.0 |
| 4 cSt Group V Ester | 5.4 |
| KV100 (cSt) | 8 |
| Calculated Viscosity Index | 178 |
| HTHS150 (cP) | 2.6 |

NON-NEWTONIAN ENGINE OIL WITH SUPERIOR ENGINE WEAR PROTECTION AND FUEL ECONOMY

CROSS-REFERENCE TO RELATED APPLICATIONS

This application claims priority to U.S. Provisional Application Ser. No. 62/396,923 filed Sep. 20, 2016, which is herein incorporated by reference in its entirety.

FIELD

This disclosure relates to a low viscosity lubricating oil composition for gasoline and diesel engines that is non-Newtonian in nature and provides a combination of excellent engine to wear protection and improved fuel efficiency.

BACKGROUND

A major challenge in engine oil formulation is simultaneously achieving engine wear protection while also maintaining fuel economy performance, over a broad temperature range. Lubricant-related performance characteristics fuel economy and wear protection are extremely advantageous attributes as measured by a variety of bench and engine tests.

Fuel efficiency requirements for passenger vehicles are becoming increasingly more stringent. New legislation in the United States and European Union within the past few years has set fuel economy and carbon emissions targets not readily achievable with today's vehicle and lubricant technology. In order to improve lubricant fuel economy performance, reduction of lubricant viscosity is one possible path.

Lubricant-related wear control is also highly desirable due to increasing use of low viscosity engine oils for improved fuel efficiency. Due to more stringent governmental regulations for vehicle fuel consumption and carbon emissions, use of low viscosity engine oils to meet these regulatory standards is becoming more prevalent. At the same time, lubricants need to provide a substantial level of durability and wear protection to engine parts due to the formation of thinner lubricant films during engine operation.

High temperature high-shear (HTHS) viscosity is the measure of a lubricant's viscosity under severe engine conditions. Under high temperatures and high stress conditions viscosity index improver degradation can occur. As this happens, the viscosity of the oil decreases which may lead to increased engine wear. HTHS is measured using ASTM D4683, which is incorporated herein by reference. Present day lubricant oils with a high temperature high-shear (HTHS) viscosity of less than 2.9 cP at 150° C. would not be expected to be able to provide acceptable passenger vehicle diesel engine wear and durability performance.

Despite the advances in lubricant oil formulation technology, there remains a need for an engine oil lubricant that effectively improves fuel economy while also providing superior engine antiwear performance.

SUMMARY

In accordance with a first aspect of the disclosure, there is provided a non-Newtonian engine oil lubricant composition comprising a major amount of a base oil comprising a Group II base stock and an optional Group V base stock, from 0.1 to 9.0 wt. % of at least one viscosity modifier and from 0.1 to 1.2 wt. % of at least one friction modifier, based on the total weight of the lubricant composition, wherein the non-Newtonian engine oil lubricant composition has a kinematic viscosity at 100 deg. C. of less than or equal to 10 cSt, and an HTHS (ASTM D4683) of less than or equal to 2.2 cP at 150° C.

In another aspect of the disclosure, there is provided a method for improving fuel efficiency and engine wear protection in an engine lubricated with a lubricating oil by using as the lubricating oil a non-Newtonian engine oil lubricant composition comprising a major amount of a base oil comprising a Group II base stock and an optional Group V base stock, from 0.1 to 9.0 wt. % of at least one viscosity modifier and from 0.1 to 1.2 wt. % of at least one friction modifier, based on the total weight of the lubricant composition, wherein the non-Newtonian engine oil lubricant composition has a kinematic viscosity at 100 deg. C. of less than or equal to 10 cSt and an HTHS (ASTM D4683) of less than or equal to 2.2 cP at 150° C.

In yet another aspect of the disclosure, there is provided a method for of making a non-Newtonian engine oil lubricant composition comprising: providing a base oil comprising a Group II base stock and an optional Group V base stock, at least one viscosity modifier and at least one friction modifier, blending from 70 to 90 wt. % of the base oil with from 0.1 to 9.0 wt. % of the at least one viscosity modifier and from 0.1 to 1.2 wt. % of the at least one friction modifier, based on the total weight of the lubricant composition, to form the non-Newtonian engine oil lubricant composition, wherein the non-Newtonian engine oil lubricant composition has a kinematic viscosity at 100 deg. C. of less than or equal to 10 cSt and an HTHS (ASTM D4683) of less than or equal to 2.2 cP at 150° C.

Other objects and advantages of the present disclosure will become apparent from the detailed description that follows.

BRIEF DESCRIPTION OF DRAWINGS

To assist those of ordinary skill in the relevant art in making and using the subject matter hereof, reference is made to the appended drawings, wherein:

FIG. 1 depicts properties of comparative 0W-20 and 0W-12 lubricating oils.

FIG. 2 depicts compositions and properties of comparative and inventive lubricating oils.

FIG. 3 depicts compositions and properties of comparative and inventive lubricating oils.

FIG. 4 M271 wear performance results of comparative and inventive lubricating oils.

FIG. 5 depicts WLTC fuel economy results of inventive lubricating oils.

FIG. 6 depicts the composition of a comparative WLTC reference oil.

DETAILED DESCRIPTION

All numerical values within the detailed description and the claims herein are modified by "about" or "approximately" the indicated value, and take into account experimental error and variations that would be expected by a person having ordinary skill in the art. A Newtonian fluid is a fluid that in which the viscous stresses arising from its flow, at every point, are linearly proportional to the local strain rate, that is the rate of change of its deformation over time. By contrast, a non-Newtonian fluid is a fluid in which the viscous stresses arising from its flow, at every point, are not linearly proportional to the local strain rate. For a non-Newtonian fluid, the viscosity (the measure of a fluid's ability to resist gradual deformation by shear or tensile stresses) is dependent on shear rate or shear rate history.

It has now been found that an engine oil lubricant composition comprising a major amount of base oil and an effective amount of at least viscosity modifier and at least one friction modifier provides a combination of improved fuel efficiency and engine wear protection. The inventive engine oil lubricant compositions are non-Newtonian in terms of viscometric properties. The inventive engine oil lubricant compositions are of relatively low viscosity as measured by kinematic viscosity at 100 deg. C. (KV100) in having a KV100 of less than or equal to 10 cSt, or less than or equal to 8 cSt, or less than or equal to 6 cSt, or less than or equal to 4 cSt, or less than or equal to 2 cSt. The engine oil lubricant composition also has an HTHS (ASTM D4683) of less than or equal to 2.2 cP at 150° C., or less than or equal to 2.0 cP at 150° C., or less than or equal to 1.8 cP at 150° C., or less than equal to 1.7 cP at 150° C. The engine oil lubricant composition also has an average High Frequency Reciprocating Rig (HFRR) wear scar of less than or equal to 181 μm. The HTHS at 150° C. is a measure of fuel efficiency with lower HTHS values yielding improved fuel economy in direct injection engines, gasoline engines, and diesel engines. The inventive engine oil lubricant composition also provides equivalent or reduced HFRR wear and or improved engine wear protection as measured by the M-271 engine wear test. In particular, the inventive engine oil lubricant composition provides an inlet and outlet cam shaft wear via the M-271 engine wear test of less than or equal to 5 μm, or less than or equal to 4 μm, or less than or equal to 3 μm, or less than or equal to 2 μm.

In one exemplary non-limiting form of the non-Newtonian engine oil lubricant composition, the composition includes a major amount of a base oil comprising a Group II base stock and an optional Group V base stock, from 0.1 to 4.0 wt. % of at least one viscosity modifier and from 0.1 to 1.0 wt. % of at least one friction modifier, based on the total weight of the lubricant composition. This non-Newtonian engine oil lubricant composition has a kinematic viscosity at 100 deg. C. of less than or equal to 10 cSt, an HTHS viscosity of less than or equal to 2.2 cP at 150° C., and an inlet and outlet cam shaft wear via the M-271 engine wear test of less than or equal to 5 μm.

The Group II base stock may be included in the engine oil lubricant composition at from 70 to 100 wt %, or 75 to 95 wt %, or from 80 to 90 wt. % in terms of the total weight of the base oil. Two different Group II base stocks were used in this invention. Group IIa (GTL) base stock has a kinematic viscosity at 100 deg. C. of from 1 to 3.7 cSt. Group IIb (hydroprocessed) base stock has a kinematic viscosity at 100 deg. C. from 1 to 3.5 cSt.

The optional Group V base stock may be any Group V base stock. Non-limiting exemplary Group V base stocks include alkylated naphthalene base stocks, ester base stocks, aliphatic ether base stocks, aryl ether base stocks, ionic liquid base stocks, and combinations thereof. The optional Group V base stock may be included in the engine oil lubricant composition at from 0 to 30 wt %, 5 to 25 wt %, or from 10 to 20 wt. % in terms of the total weight of the base oil. The Group V base stock may have a kinematic viscosity at 100 deg. C. of from 1 to 8 cSt, or 2 to 6 cSt, or 3 to 5 cSt.

Non-limiting exemplary viscosity modifiers include linear or star-shaped polymers and copolymers of methacrylate, butadiene, olefins, isoprene or alkylated styrenes, polyisobutylene, polymethacrylate, ethylene-propylene hydrogenated block copolymer of styrene and isoprene, polyacrylates, styrene-isoprene block copolymer, styrene-butadiene copolymer, ethylene-propylene copolymer, hydrogenated star polyisoprene, and combinations thereof. The at least one viscosity modifier may be included in the engine oil lubricant composition at from 0.01 to 4 wt %, or 0.1 to 4 wt %, or 0.01 to 2 wt %, or 0.1 to 1 wt. %, or 0.2 to 0.5 wt. % on a solid polymer basis in terms of the total weight of the lubricating composition.

Non-limiting exemplary friction modifiers include Mo-dithiocarbamates (Mo(DTC)), Mo-dithiophosphates (Mo(DTP)), Mo-amines (Mo(Am)), Mo-alcoholates, Mo-alcohol-amides, ashless friction modifiers and combinations thereof. Non-limiting exemplary ashless friction modifiers include hydroxyl-containing hydrocarbyl base oils, glycerides, partial glycerides, glyceride derivatives, fatty organic acids, fatty amines, and sulfurized fatty acids. The ashless friction modifier may be polymeric or a non-polymeric friction modifier. The at least one friction modifier may be included in the engine oil lubricant composition at from 0.1 to 1 wt %, or 0.2 to 0.8 wt %, or 0.3 to 0.7 wt %, or 0.4 to 0.6 wt. % in terms of the total weight of the lubricating composition.

The non-Newtonian engine oil lubricant composition may also include other additives typical for engine oils. These other additives may include one or more of an anti-wear additive, dispersant, antioxidant, detergent, pour point depressant, corrosion inhibitor, metal deactivator, seal compatibility additive, anti-foam agent, inhibitor, and anti-rust additive. These other additives may be provided to the lubricant composition in the form of an additive package. The additive packages may be incorporated into the non-Newtonian engine oils of the instant application at loadings of 9 to 15 wt. %, or 10 to 14 wt. %, or 11 to 13 wt. % based on the total weight of the composition.

Also provided herein is a method for improving fuel efficiency and engine wear protection in an engine lubricated with a lubricating oil by using as the lubricating oil a non-Newtonian engine oil lubricant composition described above. That is a non-Newtonian engine oil lubricant composition which includes a major amount of a base oil comprising a Group II base stock and an optional Group V base stock, from 0.1 to 4.0 wt. % of at least one viscosity modifier and from 0.1 to 1.0 wt. % of at least one friction modifier, based on the total weight of the lubricant composition. The non-Newtonian engine oil lubricant composition may be used to lubricate internal combustion engines, including, but not limited to, direct injection engines, gasoline engines, and diesel engines.

Also provided herein is a method of making a non-Newtonian engine oil lubricant composition including the steps of providing a base oil comprising a Group II base stock and an optional Group V base stock, at least one viscosity modifier and at least one friction modifier, and blending from 70 to 90 wt. % of the base oil with from 0.1 to 4.0 wt. % of the at least one viscosity modifier and from 0.1 to 1.0 wt. % of the at least one friction modifier, based on the total weight of the lubricant composition, to form the non-Newtonian engine oil lubricant composition.

The inventive non-Newtonian engine oil lubricant compositions, methods of using the lubricant compositions and methods of making the lubricant composition yield an engine oil having a kinematic viscosity at 100 deg. C. of less than or equal to 10 cSt, an HTHS (ASTM D4683) of less than or equal to 2.2 cP at 150° C., average HFRR wear scar of less than or equal to 181 um or less than or equal to 171 um, or less than or equal to 161 um, and an inlet and outlet cam shaft wear via the M-271 engine wear test of less than or equal to 5 um, or less than or equal to 2.4 μm. The inventive non-Newtonian engine oil lubricant compositions of the instant disclosure are particularly suitable as 0W-4, 0W-8, 0W-12 and 0W-16 viscosity grade engine oils.

Base Oils

Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV.

Non-limiting exemplary Group V base stocks include alkylated naphthalene base stock, ester base stock, aliphatic ether base stock, aryl ether base stock, ionic liquid base stock, and combinations thereof.

The table below summarizes properties of each of these five groups.

| | Base Oil Properties | | |
|---|---|---|---|
| | Saturates | Sulfur | Viscosity Index |
| Group I | <90 &/or | >0.03% & | ≥80 & <120 |
| Group II | ≥90 & | ≤0.03% & | ≥80 & <120 |
| Group III | ≥90 & | ≤0.03% & | ≥120 |
| Group IV | Includes polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 100 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

The base oil constitutes the major component of the engine oil lubricant composition of the present invention and typically is present in an amount ranging from about 50 to about 99 wt %, e.g., from 70 to 90 wt. % or from about 85 to about 95 wt %, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 1.0 cSt to about 16.0 cSt (or $mm^2/s$) at 100° C., preferably of about 1.0 cSt to about 12.0 cSt (or $mm^2/s$) at 100° C., more preferably of about 2.0 cSt to about 8.0 cSt (or $mm^2/s$) at 100° C. and even more preferably of about 2.0 cSt to about 4.0 cSt (or $mm^2/s$) at 100° C. Mixtures of synthetic and natural base oils may be used if desired.

The engine oil lubricant composition of the present invention has an HTHS viscosity of less than or equal to 2.2 cP at 150° C., or less than or equal to 2.1 cP at 150° C., or less than or equal to 2.0 cP at 150° C., or less than or equal to 1.9 cP at 150° C., and preferably about 2.0 cP at 150° C.

Additives

While there are many different types of antiwear additives, for several decades the principal antiwear additive for internal combustion engine crankcase oils is a metal alkylthiophosphate and more particularly a metal dialkyldithiophosphate in which the metal constituent is zinc, or zinc dialkyldithiophosphate (ZDDP). ZDDP can be primary, secondary or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lubricant oil composition, although more or less can often be used advantageously. Preferably, the ZDDP is a secondary ZDDP and present in an amount of from about 0.6 to 1.0 wt %, or from 0.6 to 0.91 wt % of the total lubricant composition.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.5 to 8 wt %.

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

Viscosity index improvers may be used in an amount of about 0.01 to 4 wt %, or 0.01 to 2 wt %, or 0.1 to 1 wt %, or 0.2 to 0.5 wt %, on a solid polymer basis.

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in "Lubricants and Related Products", op cit discloses a number of overbased metal salts of various sulfonic acids which are useful as detergents and dispersants in lubricants. The book entitled "Lubricant Additives", C.V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

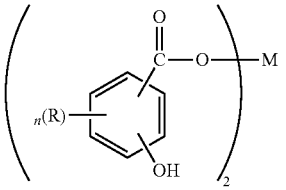

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039, for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, or 0.01 to 4 wt %, or 0.01 to 3 wt %, or 0.01 to 2.2 wt %, or 0.01 to 1.5 wt % and preferably, about 0.1 to 3.5 wt %.

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Paracoupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo(Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; and WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers. Ashless friction modifiers may include polymeric and or non-polymeric molecules.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present invention are shown in Table A below.

Note that many of the additives are shipped from the manufacturer and used with a certain amount of base oil diluent in the formulation. Accordingly, the weight amounts in the table below, as well as other amounts mentioned in this specification, are directed to the amount of active ingredient (that is the non-diluent portion of the ingredient). The wt % indicated below are based on the total weight of the lubricating oil composition.

TABLE 1

Typical Amounts of Various Lubricant Oil Components

| Compound | Approximate wt % (Useful) | Approximate wt % (Preferred) |
|---|---|---|
| Detergent | 0.01-6 | 0.01-4 |
| Dispersant | 0.1-20 | 0.1-8 |
| Friction Modifier | 0.01-5 | 0.01-1.5 |
| Viscosity Index Improver (solid polymer basis) | 0.0-4 | 0.01-4, more preferably 0.01-2, most preferably |
| Antioxidant | 0.1-5 | 0.1-1.5 |
| Anti-wear Additive | 0.01-6 | 0.01-4 |
| Pour Point Depressant (PPD) | 0.0-5 | 0.01-1.5 |
| Anti-foam Agent | 0.001-3 | 0.001-0.15 |
| Base stock or base oil | Balance | Balance |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account. The additive package may be incorporated into the non-Newtonian engine oils of the instant application at loadings of 9 to 15 wt. %, or 10 to 14 wt. %, or 11 to 13 wt. % based on the total weight of the composition.

The following non-limiting examples are provided to illustrate the invention.

EXAMPLES

Lubricating oil compositions according to the disclosure were prepared according to the formulations shown in FIGS. 1, 2 and 3 below. Comparative Example 1 is a non-Newtonian lubricating oil composition, and it has an HTHS viscosity (2.60 cP) that is outside the inventive range for HTHS. Comparative example 2 is a Newtonian lubricating oil composition because it does not include at least one viscosity modifier.

The non-Newtonian lubricating oil compositions (inventive examples) include a combination of at least one viscosity modifier and at least one friction modifier. Notably, the inventive examples have no Group III and no Group IV or less than 5% of Group IV base stocks.

For the inventive and comparative examples of FIGS. 1 and 2, the KV100, the HTHS viscosity at 150° C., and the average HFRR wear scar were measured. It can be seen that each of the inventive examples have an HTHS viscosity of less than or equal to 2.02 cP, a KV100 of less than or equal to 5.72 cSt, and an average HFRR wear scar less than or equal to 181 um.

COMPARATIVE EXAMPLES

Comparative examples were produced for testing. The properties and composition of Comparative Example 1 (0W-20 viscosity grade that is non-Newtonian) and Comparative Example 2 (0W-12 viscosity grade that is Newtonian) are shown in FIGS. 1 and 2 below. The 0W-12 Newtonian formulation has the same formulation as the 0W-20 non-Newtonian formulation, but without the use of a viscosity modifier. Base oil viscometrics were balanced to meet a 0W-12 viscosity grade according to SAE J300 specifications. This formulation provided a 0.8% ash and 2.2 cP HTHS viscosity. The other physical and chemical properties of these comparative examples are shown in FIG. 2 below.

INVENTIVE EXAMPLES

Inventive examples were produced for testing. The compositions are shown in FIGS. 2 and 3 below. All of the inventive examples included one or more viscosity modifiers. Inventive Examples 2, 5, 6, 7, 8, 9, 11, and 12 have HFRR wear scars of 181 μm or lower. HFRR Test conditions can be described as follows: 500 μm stroke length, 60 Hz frequency, 400 g load, and temperature ramp from 32° C. to 195° C. at 2° C. per minute. These measurements of wear are equivalent to or less than the HFRR wear scars of Comparative Examples 1 and 2.

The ball and disk properties for HFRR testing are described in Table 2 below.

TABLE 2

| | Metallurgy | Roughness, μm | Hardness | Diameter, mm |
|---|---|---|---|---|
| Ball | AISI 52100 Steel | <0.05 | 58-66 Rockwell C scale | 6.00 |
| Disk | AISI 52100 Steel | <0.02 | 190-210 Hv30 | not applicable |

Performance evaluation of the formulations for wear protection is given in FIG. 4 below. The wear performance of Comparative Example 2 and Inventive Example 2 were evaluated using the M271 wear test. The engine used in the M271 wear test evaluation was a 1.8 L 120 kW Daimler M271E18ML engine run for 250 hours and is required for FF MB225.30/.31 and SF MB 229.3/5/31/51/52/61/71 specifications. The inlet and outlet camshaft wear are two of the performance parameters for evaluating wear performance. The inlet and outlet camshaft wear data in FIG. 4 show that Inventive Example 2 yields significantly less wear than Comparative Example 2.

As can be seen from the foregoing figures, the inventive examples provided a combination of improved antiwear properties as measured by the M271 wear test while also providing a substantial improvement in fuel economy as measured by the HTHS viscosity when compared to the comparative oil examples.

Performance evaluation of the formulations for fuel economy using the Worldwide Harmonized Light Vehicles Test Cycle (WLTC) is given in FIG. 5 below. The fuel economy performance of Inventive Example 11 and Inventive Example 12 were evaluated using the WLTC fuel economy test. One gasoline-powered vehicle (Audi A4) and two diesel-powered vehicles (Audi A6, MB E220d) were used for this testing. The WLTC test procedure is a cold-start fuel economy test with Low, Medium, High, and Extra High speed segments. Fuel economy was measured versus a 0W-20 Non-Newtonian reference oil with composition as described in FIG. 6 below.

As can be seen in FIG. 5, the fuel economy data show that both Inventive Example 11 and Inventive Example 12 provided statistically significant improvements in fuel economy in all three vehicles tested, in comparison to a 0W-20 finished oil.

PCT/EP Clauses:

1. A non-Newtonian engine oil lubricant composition comprising a major amount of a base oil comprising a Group II base stock and an optional Group V base stock, from 0.1 to 9.0 wt. % of at least one viscosity modifier and from 0.1 to 1.2 wt. % of at least one friction modifier, based on the total weight of the lubricant composition, wherein the non-Newtonian engine oil lubricant composition has a kinematic viscosity at 100 deg. C. of less than or equal to 10 cSt, and an HTHS (ASTM D4683) of less than or equal to 2.2 cP at 150° C.

2. The lubricant composition of clause 2, wherein the non-Newtonian engine oil lubricant composition provides an inlet and outlet cam shaft wear via the M-271 engine wear test of less than or equal to 5 μm.

3. The lubricant composition of clauses 1-2, wherein the major amount of base oil comprises from 70 to 90 wt. % of the total weight of the lubricant composition.

4. The lubricant composition of clause 3, wherein the Group II base stock comprises from 70 to 100 wt % of the total weight of the base oil.

5. The lubricant composition of clauses 1-4, wherein the optional Group V base stock comprises from 0 to 10 wt % of the total weight of the base oil.

6. The lubricant composition of clauses 1-5, wherein the Group II base stock has a kinematic viscosity at 100 deg. C. of from 2 to 6 cSt.

7. The lubricant composition of clauses 1-6, wherein the Group II base stock is a Gas-to-Liquids (GTL) base stock.

8. The lubricant composition of clauses 1-7, wherein the optional Group V base stock has a kinematic viscosity at 100 deg. C. of from 2 to 6 cSt.

9. The lubricant composition of clauses 1-8, wherein the optional Group V base stock is selected from the group consisting of an alkylated naphthalene base stock, an ester base stock, an aliphatic ether base stock, an aryl ether base stock, an ionic liquid base stock, and combinations thereof.

10. The lubricant composition of clauses 1-9, wherein the at least one viscosity modifier is a linear or star-shaped polymers and copolymers of methacrylate, butadiene, olefins, isoprene or alkylated styrenes.

11. The lubricant composition of clauses 1-10, wherein the at least one viscosity modifier is selected from the group consisting of polyisobutylene, polymethacrylate, ethylene-propylene hydrogenated block copolymer of styrene and isoprene, polyacrylates, styrene-isoprene block copolymer, styrene-butadiene copolymer, ethylene-propylene copolymer, hydrogenated star polyisoprene, and combinations thereof.

12. The lubricant composition of clauses 1-11, wherein the at least one friction modifier is selected from the group consisting of Mo-dithiocarbamates (Mo(DTC)), Mo-dithiophosphates (Mo(DTP)), Mo-amines (Mo(Am)), Mo-alcoholates, Mo-alcohol-amides, ashless friction modifiers and combinations thereof.

13. The lubricant composition of clause 12, wherein the ashless friction modifiers are selected from the group consisting of hydroxyl-containing hydrocarbyl base oils, glycerides, partial glycerides, glyceride derivatives, fatty organic acids, fatty amines, sulfurized fatty acids, and combination thereof.

14. The lubricant composition of clauses 1-13 further comprising an additive package comprising one or more of an anti-wear additive, dispersant, antioxidant, detergent, pour point depressant, corrosion inhibitor, metal deactivator, seal compatibility additive, anti-foam agent, inhibitor, and anti-rust additive.

15. The lubricant composition of clause 14 wherein the additive package comprises from 9 to 15 wt. % of the total weight of the lubricant composition.

16. The lubricant composition of clauses 1-15, wherein the engine oil is a direct injection engine oil, a gasoline engine oil or a diesel engine oil.

17. The lubricant composition of clauses 1-16, wherein the composition meets the specifications of a 0W-4, 0W-8, and 0W-12 viscosity grade engine oil.

18. The lubricant composition of clauses 1-17, wherein the Worldwide Harmonized Light Vehicles Test Cycle fuel economy % with an Audi A4 gasoline engine is less than or equal to 0.50.

19. A method for improving fuel efficiency and engine wear protection in an engine lubricated with a lubricating oil by using as the lubricating oil a non-Newtonian engine oil lubricant composition, said lubricant composition comprising a major amount of a base oil comprising a Group II base stock and an optional Group V base stock, from 0.1 to 9.0 wt. % of at least one viscosity modifier and from 0.1 to 1.2 wt. % of at least one friction modifier, based on the total weight of the lubricant composition, wherein the non-Newtonian engine oil lubricant composition has a kinematic viscosity at 100 deg. C. of less than or equal to 10 cSt and an HTHS (ASTM D4683) of less than or equal to 2.2 cP at 150° C.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated.

It is also understood that the following claims are intended to cover all of the generic and specific features of the invention herein described and all statements of the scope of the invention, which as a matter of language, might be said to fall there between.

The invention claimed is:

1. A non-Newtonian engine oil lubricant composition comprising about 78.48 to 78.72 wt. % of a 3 cSt at 100° C. Group II base stock, about 1.08 wt. % of a 4 cSt at 100° C. Group IV base stock and about 5.4 wt. % of 4 cSt at 100° C. Group V base stock, about 0.12 wt. % of a styrene isoprene block type viscosity modifier, about 0.15 to 0.85 wt. % of a friction modifier selected from the group consisting of molyalkylthiocarbamide, ethoxylated fatty ester, and combinations thereof and about 13.83 to 14.09 wt. % of other engine oil additives, based on the total weight of the lubricant composition, wherein the non-Newtonian engine oil lubricant composition has a kinematic viscosity at 100 deg. C. of less than or equal to 4.66 cSt, an average High Frequency Reciprocating Rig (HFRR) wear scar of less than or equal to 165 um and an HTHS (ASTM D4683) of less than or equal to 1.8 cP at 150° C.

2. The lubricant composition of claim 1, wherein the non-Newtonian engine oil lubricant composition provides an inlet and outlet cam shaft wear via the M-271 engine wear test of less than or equal to 5 um.

3. The lubricant composition of claim 1, wherein the Group II base stock is selected from the group consisting of a Gas-to-Liquids (GTL) base stock, a hydroprocessed base stock and combinations thereof.

4. The lubricant composition of claim 3, wherein the Group II base stock is a Gas-to-Liquids (GTL) base stock.

5. The lubricant composition of claim 1, wherein the Group IV base stock is PAO.

6. The lubricant composition of claim 1, wherein the Group V base stock is an ester base stock.

7. The lubricant composition of claim 1 wherein the other engine oil additives comprise one or more of an anti-wear additive, dispersant, antioxidant, detergent, pour point depressant, corrosion inhibitor, metal deactivator, seal compatibility additive, anti-foam agent, inhibitor, and anti-rust additive.

8. The lubricant composition of claim 1, wherein the engine oil is a direct injection engine oil, a gasoline engine oil or a diesel engine oil.

9. The lubricant composition of claim 1, wherein the composition meets the specifications of a 0W-4, 0W-8, and 0W-12 viscosity grade engine oil.

10. The lubricant composition of claim 1, wherein the Worldwide Harmonized Light Vehicles Test Cycle fuel economy % with an Audi A4 gasoline engine is less than or equal to 0.50.

11. A method for improving fuel efficiency and engine wear protection in an engine lubricated with a lubricating oil by using as the lubricating oil a non-Newtonian engine oil lubricant composition, said lubricant composition comprising about 78.48 to 78.72 wt. % of a 3 cSt at 100° C. Group II base stock, about 1.08 wt. % of a 4 cSt at 100° C. Group IV base stock and about 5.4 wt. % of 4 cSt at 100° C. Group V base stock, about 0.12 wt. % of a styrene isoprene block type viscosity modifier, about 0.15 to 0.85 wt. % of a friction modifier selected from the group consisting of molyalkylthiocarbamide, ethoxylated fatty ester, and combinations thereof and about 13.83 to 14.09 wt. % of other engine oil additives, based on the total weight of the lubricant composition, wherein the non-Newtonian engine oil lubricant composition has a kinematic viscosity at 100 deg. C. of less than or equal to 4.66 cSt, an average High Frequency Reciprocating Rig (HFRR) wear scar of less than or equal to 165 μm and an HTHS (ASTM D4683) of less than or equal to 1.8 cP at 150° C.

12. The method of claim 11, wherein the non-Newtonian engine oil lubricant composition provides an inlet and outlet cam shaft wear via the M-271 engine wear test of less than or equal to 5 μm.

13. The method of claim 11, wherein the Group II base stock is selected from the group consisting of a Gas-to-Liquids (GTL) base stock, a hydroprocessed base stock and combinations thereof.

14. The method of claim 13, wherein the Group II base stock is a Gas-to-Liquids (GTL) base stock.

15. The method of claim 11, wherein the Group IV base stock is PAO.

16. The method of claim 11, wherein the Group V base stock is an ester base stock.

17. The method of claim 11 wherein the other engine oil additives comprise one or more of an anti-wear additive, dispersant, antioxidant, detergent, pour point depressant, corrosion inhibitor, metal deactivator, seal compatibility additive, anti-foam agent, inhibitor, and anti-rust additive.

18. The method of claim 12, wherein the engine is an internal combustion engine selected from the group consisting of a direct injection engine, a gasoline engine, and a diesel engine.

19. The method of claim 12, wherein the composition meets the specifications of a 0W-4, 0W-8, and 0W-12 viscosity grade engine oil.

20. The method of claim 11, wherein the Worldwide Harmonized Light Vehicles Test Cycle fuel economy % with an Audi A4 gasoline engine is less than or equal to 0.50.

21. A method of making a non-Newtonian engine oil lubricant composition comprising:

blending from about 78.48 to 78.72 wt. % of a 3 cSt at 100° C. Group II base stock, about 1.08 wt. % of a 4 cSt at 100° C. Group IV base stock and about 5.4 wt. % of 4 cSt at 100° C. Group V base stock, about 0.12 wt. % of a styrene isoprene block type viscosity modifier, about 0.15 to 0.85 wt. % of a friction modifier selected from the group consisting of molyalkylthiocarbamide, ethoxylated fatty ester, and combinations thereof and about 13.83 to 14.09 wt. % of other engine oil additives, based on the total weight of the lubricant composition, to form the non-Newtonian engine oil lubricant composition, wherein the non-Newtonian engine oil lubricant composition has a kinematic viscosity at 100 deg. C. of less than or equal to 4.66 cSt, an average High Frequency Reciprocating Rig (HFRR) wear scar of less than or equal to 165 μm and an HTHS (ASTM D4683) of less than or equal to 1.8 cP at 150° C.

22. The method of claim 21, wherein the non-Newtonian engine oil lubricant composition provides an inlet and outlet cam shaft wear via the M-271 engine wear test of less than or equal to 5 μm.

* * * * *